US007272342B2

(12) United States Patent
Nagashima et al.

(10) Patent No.: US 7,272,342 B2
(45) Date of Patent: Sep. 18, 2007

(54) IMAGE FORMING APPARATUS HAVING A DETACHABLE CARTRIDGE INCLUDING A PHOTOCONDUCTIVE DRUM WITH AXIS SHAFT HAVING A MINIMAL ROTATIONAL ECCENTRICITY, AND A METHOD OF ASSEMBLING THE IMAGE FORMING APPARATUS

(75) Inventors: Hiroyuki Nagashima, Kanagawa-ken (JP); Kazuyuki Sugihara, Kanagawa-ken (JP); Katsumi Masuda, Tokyo (JP); Hideki Kimura, Tokyo (JP); Kiyotaka Sakai, Kanagawa-ken (JP); Kazuhisa Sudo, Kanagawa-ken (JP); Tsuyoshi Imamura, Kanagawa-ken (JP)

(73) Assignee: Ricoh Co., Ltd., Tokyo (JP)

( * ) Notice: Subject to any disclaimer, the term of this patent is extended or adjusted under 35 U.S.C. 154(b) by 0 days.

(21) Appl. No.: 11/503,298

(22) Filed: Aug. 14, 2006

(65) Prior Publication Data

US 2006/0275053 A1 Dec. 7, 2006

Related U.S. Application Data

(62) Division of application No. 10/879,296, filed on Jun. 30, 2004, now abandoned.

(30) Foreign Application Priority Data

Jun. 30, 2003 (JP) ..... 2003-187839

(51) Int. Cl.
*G03G 15/00* (2006.01)

(52) U.S. Cl. ..... 399/117; 399/159

(58) Field of Classification Search ..... 399/117, 399/159, 167; 492/15

See application file for complete search history.

(56) References Cited

U.S. PATENT DOCUMENTS

| | | | | |
|---|---|---|---|---|
| 4,839,690 | A | 6/1989 | Onoda et al. | |
| 5,414,493 | A | 5/1995 | Fujii et al. | |
| 5,457,520 | A | 10/1995 | Schell et al. | |
| 6,072,968 | A * | 6/2000 | Nomura et al. | 399/113 |
| 6,192,210 | B1 | 2/2001 | Munenori et al. | |
| 6,249,661 | B1 | 6/2001 | Saitoh et al. | |
| 6,615,722 | B2 | 9/2003 | Alberstadt et al. | |
| 2002/0025188 | A1 | 2/2002 | Otani et al. | |
| 2002/0025191 | A1 | 2/2002 | Kitayama | |
| 2002/0110388 | A1 | 8/2002 | Yokomori et al. | |
| 2003/0175044 | A1 | 9/2003 | Chavez et al. | |
| 2004/0005169 | A1 | 1/2004 | Yokomori et al. | |

FOREIGN PATENT DOCUMENTS

| | | |
|---|---|---|
| EP | 0 533 484 | 3/1993 |
| EP | 1 055 979 | 11/2000 |
| EP | 1 286 229 | 2/2003 |
| JP | 9-281849 | 10/1997 |
| JP | 2001-194249 | 7/2001 |
| JP | 2001-208044 | 8/2001 |

* cited by examiner

*Primary Examiner*—David M. Gray
*Assistant Examiner*—Ryan D. Walsh
(74) *Attorney, Agent, or Firm*—Oblon, Spivak, McClelland, Maier & Neustadt, P.C.

(57) ABSTRACT

An image forming apparatus includes an image forming mechanism and an image bearing member. The image forming mechanism is configured to form an image. The image bearing mechanism is detachably provided to the image forming apparatus. The image bearing mechanism includes an image bearing member configured to bear the image formed by the image forming mechanism, and a through shaft configured to support the image bearing member.

14 Claims, 11 Drawing Sheets

IMAGE FORMING APPARATUS HAVING A DETACHABLE CARTRIDGE INCLUDING A PHOTOCONDUCTIVE DRUM WITH AXIS SHAFT HAVING A MINIMAL ROTATIONAL ECCENTRICITY, AND A METHOD OF ASSEMBLING THE IMAGE FORMING APPARATUS

CROSS REFERENCE TO RELATED APPLICATIONS

The present application claims priority under 35 U.S.C. § 119 to Japanese Patent Application No. 2003-187839 filed on Jun. 30, 2003, in the Japan Patent Office, the entire contents of which are incorporated herein by reference.

BACKGROUND OF THE INVENTION

Field of the Invention

The present invention relates to an image forming method and apparatus and a process cartridge included in the image forming apparatus, and more particularly to an image forming method and apparatus capable of reducing eccentricity of a photoconductive drum integrally engaged with a through shaft, and a process cartridge including the photoconductive drum and being detachably provided to the image forming apparatus.

DISCUSSION OF THE BACKGROUND

A background image forming apparatus, such as a copying machine, a facsimile machine, a printing machine and so forth, generally includes an image bearing member and a developing unit. The image bearing member carrying an electrostatic latent image on a surface thereof receives toner supplied by the developing unit so that the electrostatic latent image is visualized as a toner image. The toner image is then transferred onto a sheet-like transfer medium such as a transfer paper.

Such a background image forming apparatus may include a process unit to which an image bearing member, a developing unit, a charging unit and other image processing components that are integrally mounted. The process cartridge is detachably arranged in the background image forming apparatus.

When a photoconductive drum working as the image bearing member is assembled to the background image forming apparatus, the photoconductive drum is pushed against a rotary shaft extending from a body of the image forming apparatus in a longitudinal direction of the photoconductive drum such that the rotary shaft is inserted into openings formed along an axis of the photoconductive drum. To increase a positioning accuracy of the photoconductive drum in both longitudinal and radial directions, a technique has been proposed such that the photoconductive drum is provided with flanges at both ends thereof, and the flanges hold a rotary shaft. Another technique has been proposed such that a rotary shaft extending from a body of the image forming apparatus is inserted into flanges disposed at both ends of the photoconductive drum, a knob member is screwed to a thread portion of a leading portion of the rotary shaft, and the photoconductive drum is thrust to the other end of the rotary shaft so that the photoconductive drum is positioned.

On the other hand, the movements of the photoconductive drum and the rotary shaft holding the photoconductive drum may not be synchronized due to a method of fabricating the photoconductive drum and the rotary shaft. When a degree of such eccentricity is great, each gap between the photoconductive drum and a developing roller, a transfer roller and a charging unit may drastically vary in one cycle of the photoconductive drum. The deviation of each gap may cause a change of an electric field generated in each process and a variation of a transfer pressure, which results in a disturbance in an image. Therefore, a process accuracy of the rotary shaft inserted into the photoconductive drum needs to be increased to obtain a runout precision having less variation of each gap formed between the photoconductive drum and each unit.

In the background image forming apparatus, the photoconductive drum is a component to be exchanged from time to time due to its life. Therefore, a relationship of tolerances of the shaft and the photoconductive drum may cause a runout of the photoconductive drum affecting the image. Specifically, when the photoconductive drum is integrally mounted to a process unit which is detachable from the image forming apparatus, a relationship of positions in an axial direction of the photoconductive drum and the shaft may vary each time the process unit is installed to the image forming apparatus. As a result, the relationship of runout tolerances of the photoconductive drum and the shaft leads to an image defect.

With a downsizing of the image forming apparatus, it has been difficult to obtain a space in the image forming apparatus so as to install the photoconductive drum to the rotary shaft extending from the body of the image forming apparatus, which leads to a difficult installation. Specifically, when a stopping member, such as a retaining ring, for preventing a movement of the photoconductive drum in an axial direction is attached after the photoconductive drum is installed to the rotary shaft, no sufficient space is left in the image forming apparatus and the installation of the stopping member becomes difficult.

SUMMARY OF THE INVENTION

The present invention has been made under the above-described circumstances.

It is an object of the present invention to provide a novel image forming apparatus in which an image bearing member integrally engaged with a through shaft is detachable from the image forming apparatus and is capable of reducing an eccentricity of the photoconductive drum to prevent turbulence of an electric field and a defect of an image.

It is another object of the present invention to provide a process cartridge including an image bearing member integrally engaged with a through shaft and being detachably provided to an image forming apparatus.

In one exemplary embodiment, a novel image forming apparatus includes an image forming mechanism configured to form an image, and an image bearing mechanism detachably provided to the image forming apparatus. The image bearing mechanism includes an image bearing member configured to bear the image formed by the image forming mechanism, and a through shaft configured to support the image bearing member.

The image bearing member may be rotatably supported by the through shaft.

The image bearing member may rotate with the through shaft.

The image bearing member may be in a hollow cylindrical shape and may have first and second open end portions and an intermediate hollow portion arranged between and communicating with the first and second open end portions. The image bearing mechanism may further include a first flange including a first opening at a center portion thereof and arranged at the first open end portion of the image bearing member, and a second flange including a second opening at a center portion thereof and arranged at the second open end portion of the image bearing member. The through shaft may be inserted with its leading end into the intermediate hollow portion of the image bearing member through the first opening of the first flange and may be passed through the second opening of the second flange.

The through shaft may include first and second end portions which are accommodated in the first opening of the first flange and the second opening of the second flange, respectively, and have an outer radial diameter greater than other portions between the first and second end portions and smaller than an inner radial diameter of the first opening of the first flange and the second opening of the second flange.

The second opening of the second flange may include first and second end portions which are accommodated in the first opening of the first flange and the second opening of the second flange, respectively. The first end portion has an outer radial diameter greater than portions other than the first end portion and smaller than an inner radial diameter of the first opening of the first flange and the second end portion has an outer radial diameter smaller than an outer radial diameter of the second opening of the second flange.

The through shaft may include the leading end having a tapered surface and the second opening of the second flange comprises a tapered guide configured to guide the leading end of the through shaft.

The through shaft may have a thin portion arranged in a vicinity of the leading end and with an outer radial diameter smaller than other portions, and the second opening of the second flange may have an inner circumferential step portion with an inner radial diameter smaller than other portions thereof. The thin portion of the through shaft may be engaged with the inner circumferential step portion of the second flange when the through shaft is inserted into the second opening of the second flange via the hollow portion.

The inner circumferential step portion may include an elastic material.

The through shaft may include retaining members configured to retain the through shaft at respective positions outside and close to outer surfaces of the first flange and second flanges.

The through shaft may include a stopper mounted vertically to the through shaft and in a vicinity of a trailing end thereof and configured to engage the first flange.

The stopper may include a parallel pin.

The first flange may include a cavity arranged in the outer surface thereof and close to the first opening and configured to engage with the stopper.

A portion of the first flange forming the cavity may include an elastic material.

The first flange may further include a stopper accommodating portion arranged at an innermost portion of the cavity and configured to accommodate the stopper, and a protruding guide including an elastic material, arranged adjacent to the stopper accommodating portion in the cavity and configured to guide the stopper of the through shaft into the stopper accommodating portion.

The protruding guide may have a tapered guide space communicating with the stopper accommodating portion and having a space width decreasing towards the stopper accommodating portion.

In one exemplary embodiment, a novel method for assembling an image forming apparatus includes the steps of providing an image bearing member formed in a hollow cylindrical shape and having first and second open end portions and intermediate hollow portion arranged between and communicating with the first and second open end portions, arranging a first flange including a first opening at a center portion thereof at the first open end portion of the image bearing member, arranging a second flange including a second opening at a center portion thereof at the second open end portion of the image bearing member, preparing a through shaft, inserting the through shaft into the image bearing member through the first opening of the first flange, the intermediate hollow portion, and the second opening of the second flange, engaging the through shaft with the image bearing member, and mounting the image bearing member engaged with the through shaft detachably to the image forming apparatus.

The mounting step may mount the image bearing member for rotation to the image forming apparatus.

The mounting step may mount the image bearing member such that the image bearing member rotates with the through shaft.

The inserting step may insert the through shaft with its leading end into the intermediate hollow portion of the image bearing member through the first opening of the first flange and may be passed through the second opening of the second flange.

The preparing step may prepare the through shaft which includes first and second end portions which are accommodated in the first opening of the first flange and the second opening of the second flange, respectively, and have an outer radial diameter greater than other portions between the first and second end portions and smaller than an inner radial diameter of the first opening of the first flange and the second opening of the second flange.

The preparing step may prepare the through shaft which includes first and second end portions which are accommodated in the first opening of the first flange and the second opening of the second flange, respectively. The first end portion has an outer radial diameter greater than portions other than the first end portion and smaller than an inner radial diameter of the first opening of the first flange and the second end portion has an outer radial diameter smaller than an outer radial diameter of the second opening of the second flange.

The through shaft prepared by the preparing step may have a leading end having a tapered surface, and the second opening of the second flange comprises a tapered guide configured to guide the leading end of the through shaft.

The through shaft inserted by the inserting step may have a thin portion arranged in a vicinity of the leading end and with an outer radial diameter smaller than other portions, and the second opening of the second flange may have an inner circumferential step portion with an inner radial diameter smaller than other portions thereof. The thin portion of the through shaft may be engaged with the inner circumferential step portion of the second flange when the through shaft is inserted in the inserting step into the second opening of the second flange via the intermediate hollow portion.

The method may further include the step of attaching a retaining member to the through shaft at a position in a vicinity of an outside surface of first flange before the inserting step.

The engaging step may engage the through shaft with the image bearing member using another retaining member at a position in a vicinity of an outside surface of the second flange.

The method may further include the step of fixing a stopper vertically to the through shaft at a portion in a vicinity of a trailing end of the through shaft before the inserting step.

The first flange arranged in the arranging step may have a cavity.

The novel method may further include the steps of guiding the stopper of the through shaft using a protruding guide arranged in the cavity, and accommodating the stopper in a stopper accommodating portion arranged at an innermost portion of the cavity, before the engaging step.

The protruding guide arranged in the guiding step may have a tapered guide space communicating with the stopper accommodating portion and having a space width decreasing towards the stopper accommodating portion.

A novel process cartridge detachably provided to an image forming apparatus includes an image forming mechanism, and an image bearing mechanism detachably provided to the image forming apparatus. The image bearing mechanism includes an image bearing member configured to bear an electrostatic latent image, and a through shaft configured to support the image bearing member.

The image forming mechanism may include at least one of a charging unit, a developing unit, and a cleaning unit.

A novel method for assembling a process cartridge detachably provided to an image forming apparatus includes the steps of providing an image bearing member formed in a hollow cylindrical shape and having first and second open end portions and an intermediate hollow portion arranged between and communicating with the first and second open end portions, arranging a first flange including a first opening at a center portion thereof at the first open end portion of the image bearing member, arranging a second flange including a second opening at a center portion thereof at the second open end portion of the image bearing member, preparing a through shaft, inserting the through shaft into the image bearing member through the first opening of the first flange, the intermediate hollow portion, and the second opening of the second flange, engaging the through shaft with the image bearing member, and mounting the image bearing member engaged with the through shaft detachably to the process cartridge.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
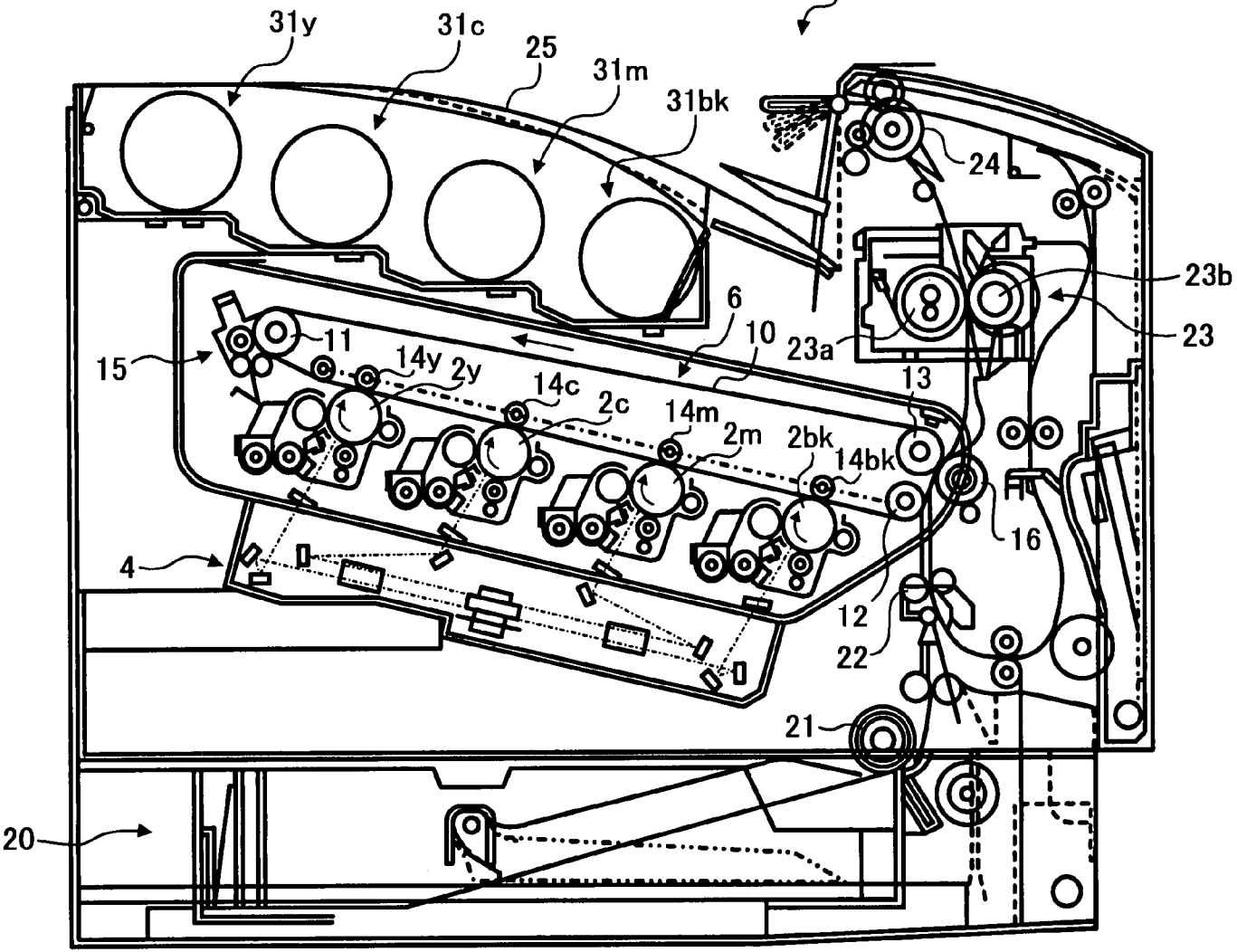
FIG. 1 is a cross-sectional view of a structure of a color printer according to an exemplary embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention area described.

Referring to FIG. 1, a color printer 1 is described as one example of an electrophotographic image forming apparatus according to an exemplary embodiment of the present invention. The color printer 1 of FIG. 1 employs a tandem system forming a color image with toners of four different colors such as yellow (Y), cyan (C), magenta (M) and black (BK).

The color printer 1 generally includes four photoconductive drums 2*y*, 2*c*, 2*m* and 2*bk*, four toner bottles 31*y*, 31*c*, 31*m* and 31*bk*, an optical writing device 4, a transfer device 6, a sheet feeding cassette 20 and a fixing device 23.

The photoconductive drums 2*y*, 2*c*, 2*m* and 2*bk* are separately arranged at different height positions in a stepped manner, and rotate in a direction as indicated by arrows in FIG. 1. Each of the photoconductive drums 2*y*, 2*c*, 2*m* and 2*bk* includes a cylindrical conductive body having a circular cross section.

The toner bottles 31*y*, 31*c*, 31*m* and 31*bk* are separately provided with respect to the photoconductive drums 2*y*, 2*c*, 2*m* and 2*bk* at an upper portion of the color printer 1 and detachably arranged to the color printer 1, so that any one of the toner bottles 31*y*, 31*c*, 31*m* and 31*bk* may separately be replaced, for example, at its toner empty state.

The optical writing device 4 is arranged below the photoconductive drums 2*y*, 2*c*, 2*m* and 2*bk* and emits laser beams towards the respective photoconductive drums 2*y*, 2*c*, 2*m* and 2*bk*.

The transfer device 6 is arranged above the photoconductive drums 2*y*, 2*c*, 2*m* and 2*bk* and includes an intermediate transfer belt 10, supporting rollers 11, 12 and 13, primary transfer rollers 14*y*, 14*c*, 14*m* and 14*bk*, and a belt cleaning device 15. The intermediate transfer belt 10 is supported by the supporting rollers 11, 12 and 13, and is held in contact with the primary transfer rollers 14*y*, 14*c*, 14*m* and 14*bk* according to the photoconductive drums 2*y*, 2*c*, 2*m* and 2*bk*, respectively. The intermediate transfer belt 10 is held in contact with the photoconductive drums 2*y*, 2*c*, 2*m* and 2*bk* and travels in a same direction the photoconductive drums 2*y*, 2*c*, 2*m* and 2*bk* rotate, as indicated by an arrow shown in FIG. 1.

The sheet feeding cassette 20 is provided at a lower portion of the color printer 1. The sheet feeding cassette 20 performs a sheet feeding operation with a sheet feeding roller 21, a registration roller pair 22, and a secondary transfer roller 16.

The fixing device 23 is provided at an upper right portion of the color printer 1 of FIG. 1 and includes a heat roller 23*a* and a pressure roller 23*b*. After a recording medium is processed in the fixing device 23, it is discharged by a sheet discharging roller 24 to outside onto a sheet discharging tray 25 of the color printer 1.

As described above, the photoconductive drums 2*y*, 2*c*, 2*m* and 2*bk* are held in contact with the intermediate transfer belt 10, and are rotated in a same direction the intermediate transfer belt 10 travels as shown in FIG. 1. Each of the photoconductive drums 2*y*, 2*c*, 2*m* and 2*bk* has respective components around it. Since the photoconductive drums 2*y*, 2*c*, 2*m* and 2*bk* have similar structures and functions to each other, except that the toners contained therein are of different colors, the discussion below with respect to FIGS. 2 to 11 use reference numerals for specifying components of the color printer 1 without suffixes of colors such as y, c, m and bk. In other words, the photoconductive drum 2 of FIG. 2, for example, can be any one of the photoconductive drums 2*y*, 2*c*, 2*m* and 2*bk*.

Figure 2:
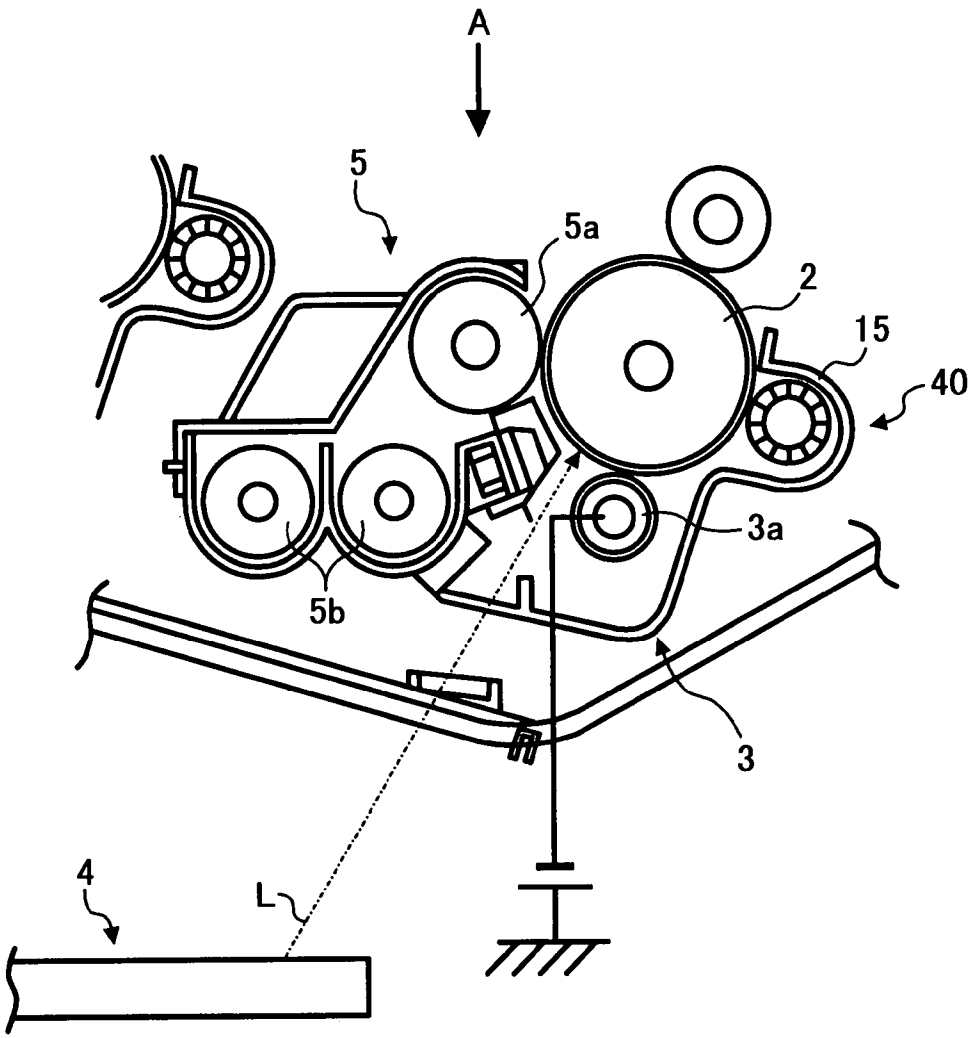
FIG. 2 is a cross-sectional view of a structure of a photoconductive drum and image forming components arranged around the photoconductive drum included in the color printer of FIG. 1.

FIG. 2 exemplarily illustrates the photoconductive drum 2 and its related components, viewed from a front side of the color printer 1.

In FIG. 2, the components disposed around the photoconductive drum 2 are a charging unit 3, a developing unit 5, and a temporary toner storing unit 40.

The charging unit 3 is applied with a charged voltage to uniformly charge a surface of the photoconductive drum 2 to a predetermined polarity. The charging unit 3 includes a charging roller 3*a*. The charging unit 3 holds the charging roller 3*a* in contact with the photoconductive drum 2 so that the charging roller 3*a* can uniformly charge the surface of the photoconductive drum 2.

As shown in FIG. 1, the optical writing unit 4 emits four laser beams to the photoconductive drums 2*y*, 2*c*, 2*m* and 2*bk*. In FIG. 2, an exemplary laser beam L according to image data corresponding to any one of yellow, cyan, magenta and black colors irradiates any one of which can independently be detachable form the others, are arranged above the intermediate transfer belt 10. With the above-described structure of the toner bottle (e.g., a toner bottle 31*y*), the toner bottle alone may easily be replaced with a new toner bottle when the toner bottle is detected as being in a toner empty state, for example. This avoids an unnecessary replacement of components which are not at the end of their lives and associated with the toner bottle replaced. Thereby, other components associated with the toner bottle may be used until the end of their lives, thus contributing to a cost reduction.

As shown in FIG. 2, the developing unit 5 includes a developing roller 5*a* and toner agitating screws 5*b*.

The developing roller 5*a* is a developer bearing member, and a part of the developing roller 5*a* is exposed outside at an opening of a casing of the developing unit 5.

The toner agitating screws 5*b* agitate toner supplied from the toner bottle 31 before conveying the agitated toner towards the developing roller 5*a*. The toner is then conveyed to a developing area where the developing roller 5*a* and the photoconductive drum 2 are oppositely disposed to each other. In the developing area, the surface of the developing roller 5*a* moves in a same direction as the surface of the photoconductive drum 2 travels. The developing roller 5*a* transfers the toner to the surface of the photoconductive drum 2.

At this time, a power source (not shown) applies a voltage to the developing roller 5*a* to generate a developing electric field in the developing area. The developing electric field generates an electrostatic force between the electrostatic latent image formed on the surface of the photoconductive drum 2 and the surface of the developing roller 5*a* such that the toner on the surface of the developing roller 5*a* is attracted to the photoconductive drum 2 having the electrostatic latent image on the surface thereon. The attraction of the toner makes the electrostatic latent image formed on the photoconductive drum 2 visualize as a single color toner image.

In the transferring device 6 as shown in FIG. 1, the intermediate transfer belt 10 is arranged above the photoconductive drums 2*y*, 2*c*, 2*m* and 2*bk* and is supported by the supporting rollers 11, 12 and 13. The intermediate transfer belt 10 forms an endless belt extended with the supporting rollers 11, 12 and 13, rotating in a direction, indicated by an arrow in FIG. 1, by a motor (not shown). The toner images of different colors are transferred one after another onto the intermediate transfer belt 10 to form an overlaid full-color image.

The intermediate transfer belt 10 is held in contact with the primary transfer rollers 14*y*, 14*c*, 14*m* and 14*bk* corresponding to the photoconductive drums 2*y*, 2*c*, 2*m* and 2*bk*, respectively, to form a primary transfer nip between the photoconductive drum 2*y* and the primary transfer roller 14*y*, between the photoconductive drum 2*c* and the primary transfer roller 14*c*, and so forth. Corresponding to the photoconductive drum 2*y*, the primary transfer roller 14*y* is arranged at a position opposite to the photoconductive drum 2*y* such that the toner image formed on the surface of the photoconductive drum 2*y* is transferred onto the intermediate transfer belt 10. The primary transfer roller 14*y* receives a transfer voltage so as to transfer the color toner image onto the surface of the intermediate transfer belt 10. Through operations similar to those as described above, cyan, magenta and black images are formed on the surfaces of the respective photoconductive drums 2*c*, 2*m* and 2*bk*. Those color toner images are sequentially overlaid on the surface of the intermediate transfer belt 10 on which the yellow toner image is already formed, such that a primary overlaid toner image is formed on the surface of the intermediate transfer belt 10.

After the toner images in different colors are sequentially transferred on the intermediate transfer belt 10, the belt cleaning device 15 removes the residual toners remaining on the surface of the intermediate transfer belt 10. The belt cleaning device 15 includes a fur brush (not shown) and a cleaning blade (not shown) for effectively removing the residual toner from the surface of the intermediate transfer belt 10 and collecting the residual toner into a toner collecting tank (not shown).

In FIG. 1, the sheet feeding cassette 20 accommodates a plurality of recording media such as transfer sheets that include a transfer sheet S. The sheet feeding roller 21 and the registration roller pair 22 form a sheet conveying portion. The sheet feeding roller 21 is held in contact with the transfer sheet S. When the sheet feeding roller 21 is rotated by a drive motor (not shown), the transfer sheet S placed on the top of a stack of transfer sheets in the sheet feeding cassette 20 is fed and is conveyed to a portion between rollers of the registration roller pair 22. The registration roller pair 22 stops and feeds the transfer sheet S in synchronization with a movement of the four-color toner image towards a secondary transfer area which is a secondary nip formed between the intermediate transfer belt 10 and a secondary transfer roller 16. The secondary transfer roller 16 is applied with an adequate predetermined transfer voltage to a positive polarity such that the four-color image, formed on the surface of the intermediate transfer belt 10, is transferred on the transfer sheet S.

The transfer sheet S that has the four-color image thereon is conveyed further upward and passes between a pair of fixing rollers of the fixing device 23. The fixing device 23 includes the heat roller 23*a* having a heater therein and the pressure roller 23*b* for pressing the transfer sheet S for fixing the four-color image. The fixing device 23 fixes the four-color image to the transfer sheet S by applying heat and pressure. After the transfer sheet S passes the fixing device 23, the transfer sheet S is discharged by the sheet discharging roller 24 to the sheet discharging tray 25 provided at the upper portion of the color printer 1. The belt cleaning device 15 removes the residual toner adhering on the surface of the intermediate transfer belt 10.

After the transferring operation completes with residual toner remaining on the surface of the photoconductive drum 2, the temporary toner storing unit 40 collects residual toner remaining on the surface of the photoconductive drum 2. The temporary toner storing unit 40 separates an irregular charge toner from the residual toner remaining on the surface of the photoconductive drum 2. The temporary toner storing unit 40 then provides an extra travel shaft hole along the perimeter thereof to give a time delay to the irregular charge toner. Thereafter, the irregular charge toner is returned from the temporary toner storing unit 40 to the photoconductive drum 2.

Figure 3A:
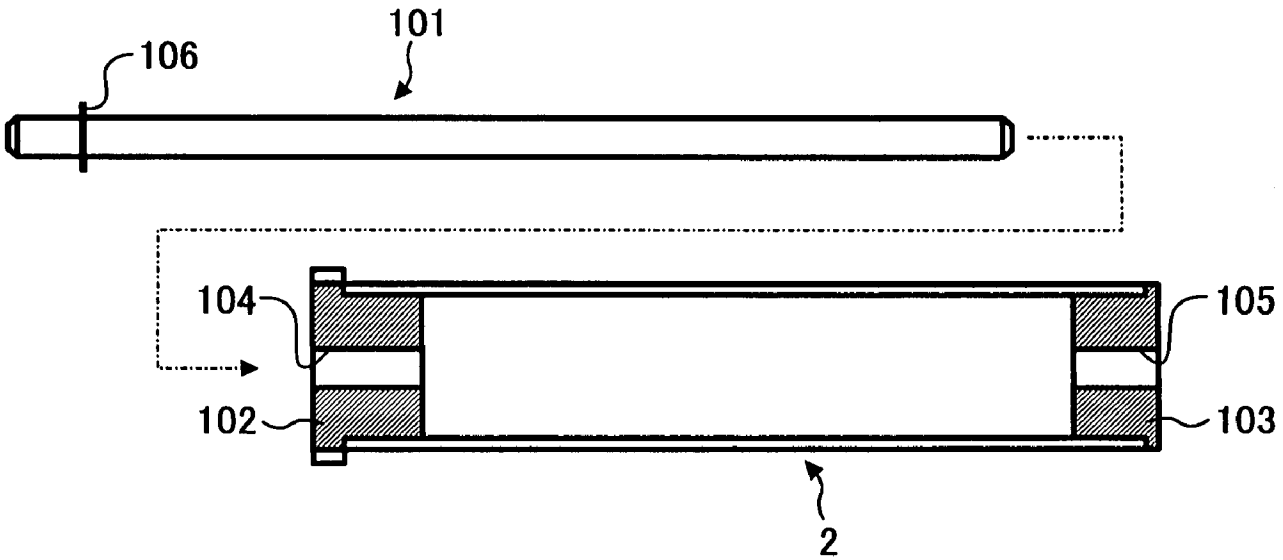
FIGS. 3A and 3B are longitudinal cross-sectional views of the photoconductive drum with flanges, and a through shaft.
Figure 3B:
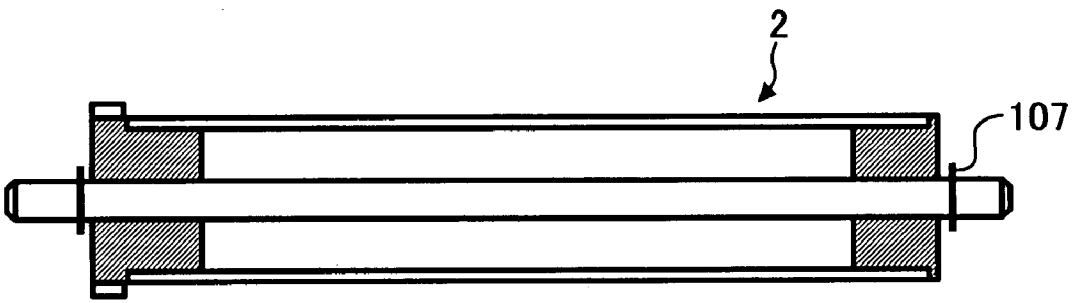

Referring now to FIGS. 3A and 3B, a structure of the photoconductive drum 2 according to an-exemplary embodiment of the present invention is described.

FIG. 3A shows the photoconductive drum 2 and a through shaft 101. The through shaft 101 is inserted into the photoconductive drum 2 as indicated by an alternate long and short dash line in FIG. 3A, and is then engaged with the photoconductive drum 2 as shown in FIG. 3B.

The photoconductive drum 2 is a hollow cylindrical shaped image bearing member having two ends in its longitudinal direction. The photoconductive drum 2 includes a first flange which is hereinafter referred to as a "shaft entrance flange" 102, and a second flange which is hereinafter referred to as a "shaft exit flange" 103. The shaft entrance flange 102 is fixedly disposed at one end of the photoconductive drum 2, and this end is referred to as an "entrance side". The shaft exit flange 103 is also fixedly disposed at the other end of the photoconductive drum 2, and this end is referred to as an "exit side". The shaft entrance flange 102 includes an entrance opening 104 at a center portion thereof, and the shaft exit flange 103 includes an exit opening 105 at a center portion thereof.

The photoconductive drum 2 has a shaft hole pierced from the one end to the other end thereof in the axial direction of the photoconductive drum 2. The through shaft 101 is inserted into the shaft hole of the photoconductive drum 2 through the entrance opening 104 and passes through the exit opening 105.

Before inserting the through shaft 101 into the shaft hole of the photoconductive drum 2, a locating snap ring 106 is generally attached onto one end portion of the through shaft 101 for positioning the locating snap ring 106 in the vicinity of the shaft entrance flange 102. This end portion is hereinafter referred to as a "trailing end". The other end portion of the through shaft 101, however, has no locating snap ring attached when the through shaft 101 is inserted. Hereinafter, this end portion of the through shaft 101 without a locating snap ring is referred to as a "leading end". The leading end of the through shaft 101 is inserted into the photoconductive drum 2, through the entrance opening 104 of the shaft entrance flange 102 and passes through the exit opening 105 of the shaft exit flange 103. After a predetermined length of the leading end of the through shaft 101 is protruded from the exit opening 105 of the shaft exit flange 103, a locating snap ring 107 is attached onto the through shaft 101 for positioning the locating snap ring 107 in the vicinity of the shaft exit flange 103. The locating snap rings 106 and 107 are then adjusted to be located in the vicinity of the shaft entrance and exit flanges 102 and 103, respectively. After inserting the through shaft 101 into the photoconductive drum 2 as described above, the photoconductive drum 2 and the through shaft 101 are integrally engaged with each other as shown in FIG. 3B, and thereby the photoconductive drum 2 may not move in its axial direction.

To examine a level of runouts of the photoconductive drum 2, tests were conducted by using the photoconductive drum 2 which is integrally engaged with the through shaft 101 and prevented from shifting in the axial direction. The photoconductive drum 2 which passed the tests is directly provided to the color printer 1 or it is once mounted to a cartridge unit, such as a process cartridge, and then to the color printer 1 as one component of the cartridge unit.

According to this embodiment of the present invention, the photoconductive drum 2 engaged with the through shaft 101 is rotatably fixed to the color printer 1 of FIG. 1, so it is prevented from vibration caused by rotation of the photoconductive drum 2.

Also, according to this embodiment of the present invention, the photoconductive drum 2 and the through shaft 101 are integrally mounted to each other and are detachable to the color printer 1. This prevents a change of accuracy of eccentricity with respect to the photoconductive drum 2 due to an eccentric movement of the photoconductive drum 2 and the through shaft 101 in the axial direction, which may generally occur after the photoconductive drum 2 is installed to the color printer 1. As a result, a gap with each component is not created by the runout of the photoconductive drum 2, and an irregular electric field caused by the gap may be reduced. Thus, an irregularity of an image may be reduced and a high quality image may be obtained.

Further, according to this embodiment of the present invention, the shaft entrance and exit flanges 102 and 103 are fixedly provided to respective ends of the photoconductive drum 2 to insert the through shaft 101 from one end portion of the photoconductive drum 2. This simply requires that the through shaft 101 is straightly inserted into the entrance opening 104 of the shaft entrance flange 102 for assembling the photoconductive drum 2. With the simple assembling as described above, the photoconductive drum 2 may be automatically assembled in a factory, and a volume of production may increase.

Figure 4:
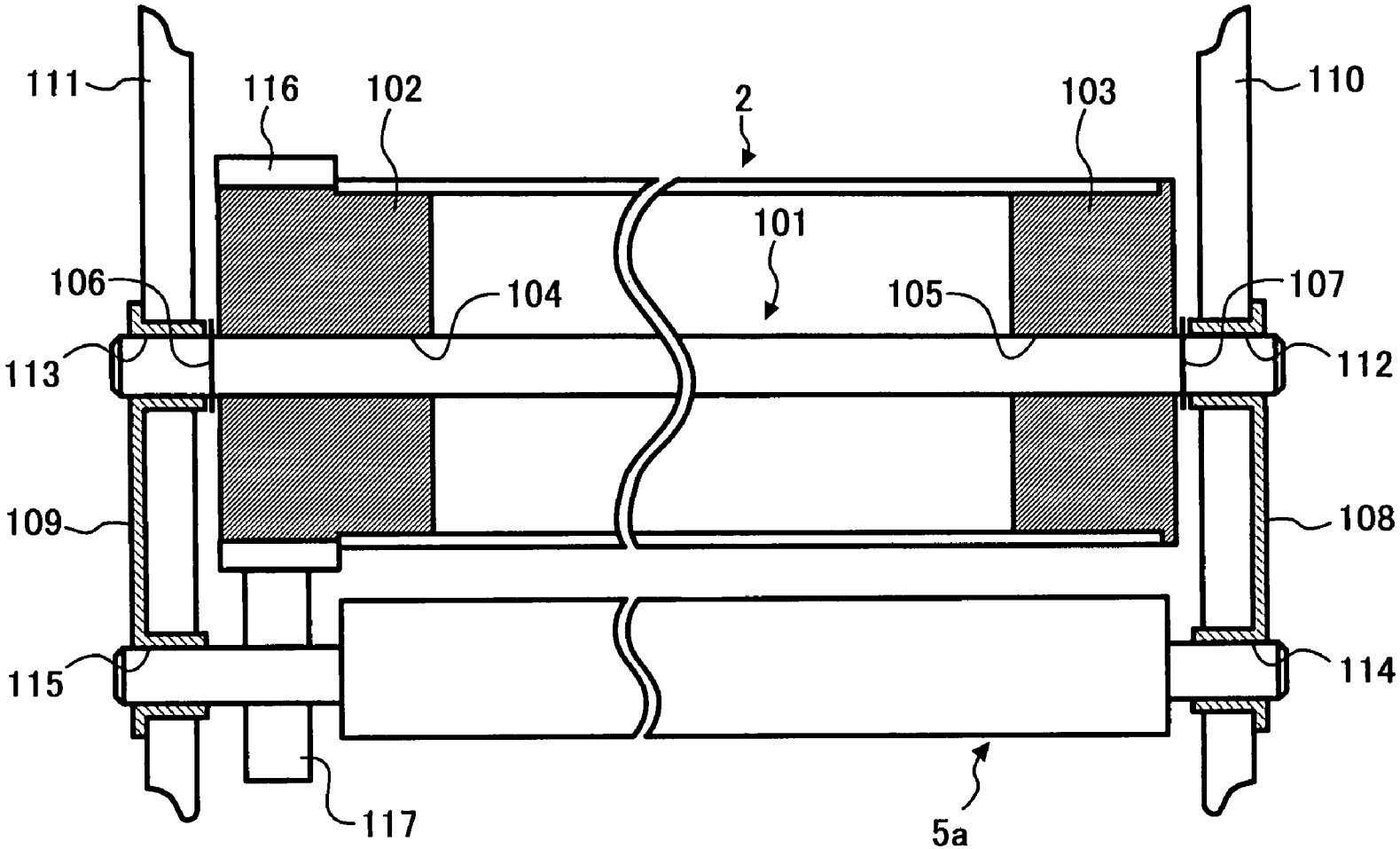
FIG. 4 is a schematic cross-sectional view of a part of the process unit of FIG. 2, viewed from a direction A of FIG. 2.

Referring to FIG. 4, a supporting structure of the photoconductive drum 2 and the developing roller 5*a* is described. FIG. 4 is an illustration of FIG. 2, viewed from a direction A. That is, the front side of the color printer 1 comes to the right hand side of FIG. 4.

As shown in FIG. 4, both ends of the photoconductive drum 2 are supported by positioning boards 108 and 109. The positioning board 108 is placed at a front side plate 110 and the positioning board 109 is placed at a rear side plate 111. The front and rear side plates 110 and 111 are provided in a pull-out unit configured to be pulled out from the color printer 1. The positioning boards 108 and 109 include photoconductive drum supporting portions 112 and 113 and developing roller supporting portions 114 and 115, respectively. The photoconductive drum supporting portions 112 and 113 and the developing roller supporting portions 114 and 115 have substantially U-shaped channel holders, respectively.

The photoconductive drum 2 integrally engaged with the through shaft 101 may be mounted to the photoconductive drum supporting portions 112 and 113 as described below. Under a condition that the pull-out unit is ready to be pulled out, the pull-out unit is pulled out from the color printer 1. The photoconductive drum 2 is installed by positioning the leading end of the through shaft 101 to the photoconductive drum supporting portion 112 and by positioning the trailing end of the through shaft 101 to the photoconductive drum supporting portion 113. As previously described, the leading and trailing ends of the through shaft 101 protrude from the exit and entrance sides of the photoconductive drum 2, respectively. To complete the installation of the photoconductive drum 2, the pull-out unit is pushed back into the color printer 1.

As an alternative, the photoconductive drum 2 engaged with the through shaft 101 may be installed as described below. The positioning board 109 is firstly fixed to the rear side plate 111 of the color printer 1. The positioning board 109 includes the photoconductive drum supporting portion 113 which has a cylindrical shape hole instead of the U-shaped channel holder. An inner diameter of the photoconductive drum supporting portion 113 is made slightly greater than an outer diameter of the through shaft 101. To install the photoconductive drum 2, one end of the through shaft 101 is inserted into the photoconductive drum supporting portion 113. By doing so, the through shaft 101 is supported by the inner surface of the photoconductive drum supporting portion 113, and the photoconductive drum 2 is preliminarily placed in the color printer 1 in a cantilever manner. The other end of the through shaft 101 is then inserted into the photoconductive drum supporting portion 112. The photoconductive drum supporting portion 112 has the same structure as that of the photoconductive drum supporting portion 113 and is included in the positioning board 108. The positioning board 108 is screwed to the front side plate 110 of the color printer 1 to complete the installation of the photoconductive drum 2.

In this embodiment, the photoconductive drum 2 rotates but the through shaft 101 does not. A gear 116 is provided to an outer surface of the shaft entrance flange 102 to convey a drive force generated by a drive motor (not shown) to the photoconductive drum 2 to rotate.

As an alternative, the photoconductive drum 2 and the through shaft 101 may rotate together. For example, the through shaft 101 may have a cross sectional surface of a D-like shape or an oval shape, and the openings 104 and 105 may have the same shape as the through shaft 101. With this structure, the photoconductive drum 2 and the through shaft 101 can rotate together.

In FIG. 4, the developing roller 5*a* is arranged next to the photoconductive drum 2. The developing roller 5*a* is also engaged with a shaft which protrudes from both ends of the developing roller 5*a* and extends horizontally. The developing roller 5*a* is supported by the developing roller supporting portions 114 and 115. A gear 117, which is engaged with the gear 116 provided to the outer surface of the flange 102, is fixedly provided to one end of the shaft extending from the developing roller 5*a*, so that the drive force generated by the drive motor is conveyed to the gear 117, thereby rotating the developing roller 5*a*.

Figure 5A:
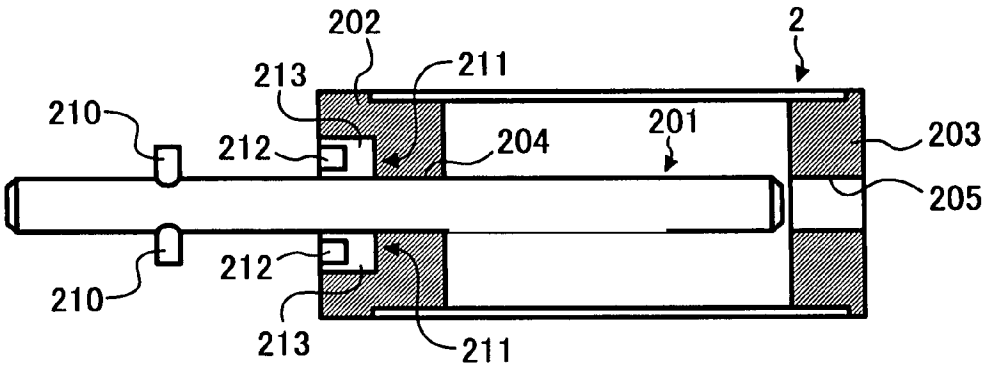
FIGS. 5A and 5B are longitudinal cross-sectional views of another structure of a through shaft and a photoconductive drum with flanges included in a color printer according to an exemplary embodiment of the present invention.
Figure 5B:
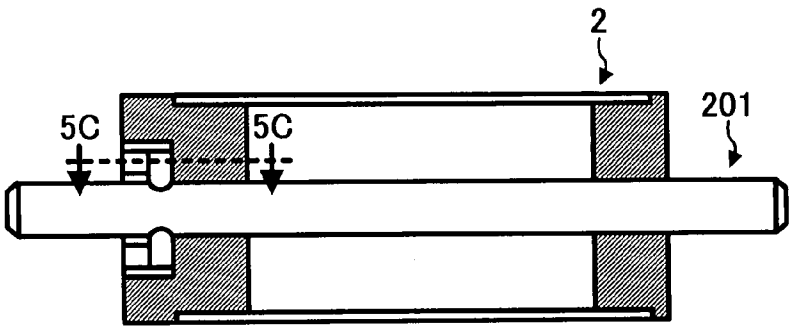
Figure 5C:
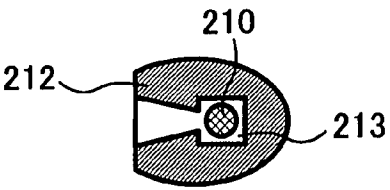
FIG. 5C is a cross-sectional view of a part of one of the flanges.

Referring now to FIGS. 5A, 5B and 5C, a structure of the photoconductive drum 2 is described according to another exemplary embodiment of the present invention.

In FIG. 5A, the photoconductive drum 2 includes a shaft entrance flange 202 and a shaft exit flange 203. The shaft entrance flange 202 includes an entrance opening 204. The shaft exit flange 203 includes an exit opening 205.

The shaft entrance and exit flanges 202 and 203 are fixedly provided at both ends, respectively, of the photoconductive drum 2. The entrance opening 204 is disposed at a center portion of the shaft entrance flange 202 and the exit opening 205 is disposed at a center portion of the shaft exit flange 203. A through shaft 201 is inserted into a shaft hole pierced from the one end to the other end of the photoconductive drum 2 in its longitudinal direction, as shown in FIG. 5A. The through shaft 201 includes a parallel pin 210 arranged at a predetermined position in the vicinity of a trailing end, which is an end portion opposite to a leading end of the through shaft 201. The parallel pin 210 is a stopper member, and is vertically arranged to the through shaft 201. The through shaft 201 is firstly inserted into the shaft hole of the photoconductive drum 2 through the entrance opening 204 and passes through the exit opening 205.

The shaft entrance flange 202 disposed at an entrance side of the photoconductive drum 2 and includes a cavity 211.

The cavity 211 is a part of the shaft entrance flange 202 and communicates with the entrance opening 204. The cavity 211 is formed at a center of an outer portion of the entrance opening 204, and has an inner radial diameter greater than that of the entrance opening 204. The cavity 211 includes two protruding guides 212 and a parallel pin accommodating portion 213.

The protruding guides 212 include an elastic material and are disposed vertically opposite to each other at portions in the vicinity of the outer side of the cavity 211. As shown in FIG. 5C, the protruding guides 212 have a guiding passage with a width which becomes smaller towards the parallel pin accommodating portion 213. The parallel pin accommodating portion 213 is arranged at an inward portion of the cavity 211.

When the leading end of the through shaft 201 is inserted through the entrance opening 204 of the shaft entrance flange 202, as shown in FIG. 5A, the parallel pin 210 contacts the protruding guides 212. As the through shaft 210 is further pushed, the parallel pin 210 forcedly open its way against the protruding guides 212. When the parallel pin 210 reaches the parallel pin accommodating portion 213, it is fixedly stored in the parallel pin accommodating portion 213. At this time, the protruding guides 212 return to the original shape thereof. Thus, the through shaft 201 and the photoconductive drum 2 are fixedly engaged, as shown in FIG. 5B, and the through shaft 201 and the photoconductive drum 2 can rotate together.

Under the above-described structure, the parallel pin 210 and the protruding guides 212 may regulate a movement of the photoconductive drum 2 without using a regulating member such as a locating snap ring, thereby reducing costs in the man-hour for assembling and in the number of parts.

Further, tests to examine a level of runouts of the photoconductive drum 2 were also conducted under the same condition as the previously described embodiment. That is, the tests were conducted by using the photoconductive drum 2 integrally engaged with the through shaft 201 and prevented from shifting in the axial direction. The photoconductive drum 2 which passed the tests is directly provided to the color printer 1 or it is once mounted to the cartridge unit, and then to the color printer 1.

In a case where the photoconductive drum 2 and the through shaft 201 rotate in an integrated manner as described above, the through shaft 201 may be operable as a part of a drive transmission member of the photoconductive drum 2. For example, the through shaft 201 provided to the color printer 1 may be fixed to the drive transmission member, such a joint (not shown) and a coupling gear (not shown). The drive transmission member transmits a drive force of the color printer 1 to the through shaft 201 to rotate. The rotation of the through shaft 201 transmits the drive force to the photoconductive drum 2, and thereby the photoconductive drum 2 is rotated.

According to this embodiment of the present invention, the through shaft 201 includes the parallel pin 210, and the cavity 211 includes the parallel pin accommodating portion 213. The cavity 211 is arranged in the vicinity of the outer portion of the entrance opening 204 of the shaft entrance flange 202. The parallel pin 201 is vertically pierced through a predetermined portion of the through shaft 201. Under this structure, a length of the parallel pin 210 may be made longer than a width of the through shaft 201, and the parallel pin 210 may not easily come off even if it is arranged in a rather loose manner. Thus, an easy attachment of the parallel pin 210 may be achieved. In addition, the parallel pin 210 may be arranged symmetrically to a central axis of the through shaft 201 in a width direction of the through shaft 201. When the through shaft 201 including the parallel pin 210 works as a drive transmission member for the photoconductive drum 2, a drive force may be generated and transmitted equally from the parallel pin 210 in a circumferential direction to the shaft entrance flange 202, thereby stably transmitting the drive force to the photoconductive drum 2.

Also, according to this embodiment of the present invention, the cavity 211 further includes the protruding guides 212. As the through shaft 201 including the parallel pin 210 is inserted into the shaft hole of the photoconductive drum 2 through the shaft entrance flange 202, the parallel pin 210 firstly collides against the protruding guides 212. Since the protruding guides 212 are elastically changeable, the parallel pin 210 may easily be pushed towards the parallel pin accommodating portion 213. After the parallel pin 210 passes through the protruding guides 212, it then reaches the parallel pin accommodating portion 213 to be stored thereto. After the parallel pin 210 is stored in the parallel pin accommodating portion 213, the protruding guides 212 return to the original shape thereof. Even though a predetermined amount of force is required to insert the through shaft 201 including the parallel pin 210 into the shaft hole of the photoconductive drum 2, the parallel pin 210 is fixedly stored in the parallel pin accommodating portion 213 and is not pulled out therefrom. Thereby, the photoconductive drum 2 and the through shaft 201 are fixedly positioned in the axial direction thereof.

Also, according to this embodiment of the present invention, the cavity 211 further includes an axially tapered area, the width of which becomes smaller towards the parallel pin accommodating portion 213. When the through shaft 201 including the parallel pin 210 is inserted into the shaft hole of the photoconductive drum 2 towards the parallel pin accommodating portion 213 of the cavity 211 of the shaft entrance flange 202, the through shaft 201 is guided by the axially tapered area, thereby easily installing the through shaft 201.

Figure 6:
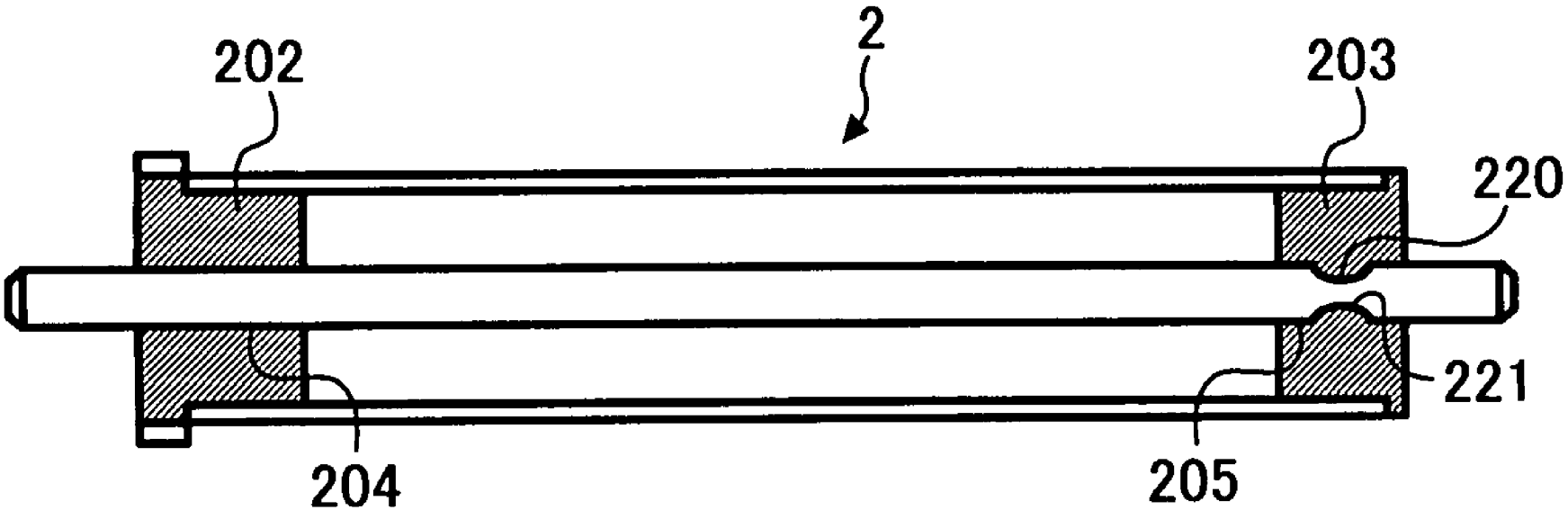
FIG. 6 is a longitudinal cross-sectional view of another structure of a through shaft and a photoconductive drum with flanges according to an exemplary embodiment of the present invention.

Referring to FIG. 6, a structure of a flange alternative to the flange of FIG. 5A for fixing the through shaft 201 to the photoconductive drum 2.

In FIG. 6, the exit opening 205 of the shaft exit flange 203 is provided with a convex area 220 at a center portion of an inner surface thereof. The through shaft 201 has a concave area 221 in the vicinity of the leading end thereof. With this structure, the convex area 220 and the concave area 221 are engaged at a predetermined position of the shaft exit flange 203.

When the through shaft 201 is inserted into the shaft hole of the photoconductive drum 2 through the entrance opening 204 of the shaft entrance flange 202, the leading end of the through shaft 201 shortly contacts the exit opening 205 of the shaft exit flange 203. As the through shaft 201 is further pushed towards the shaft exit flange 203, the concave area 221 formed on the through shaft 201 reaches the predetermined position, and is engaged with the convex area 220. Thus, the through shaft 201 and the photoconductive drum 2 are rotatably fixed in a longitudinal direction.

The convex area 220 may be made by an elastic material such as a synthetic resin, or may have a tapered guiding surface, the inner diameter of which may become smaller towards the leading end of the through shaft 201. By using such elastic material for the convex area 220, a resistance to insertion of the through shaft 201 may be reduced, and the through shaft 201 can smoothly be inserted into the shaft hole of the photoconductive drum 2.

According to this embodiment of the present invention, the through shaft 201 is fixedly mounted to the photoconductive drum 2 by engaging the concave area 221 of the through shaft 201 with the convex area 220 of the photoconductive drum 2. By doing so, the through shaft 201 is integrally mounted to the photoconductive drum 2 at the same time the through shaft 2 is fixedly engaged with the photoconductive drum 2. With this structure, a locating snap ring may not be necessary for positioning the through shaft 201 to the photoconductive drum 2 after an installation of the through shaft 201 is completed.

Figure 7A:
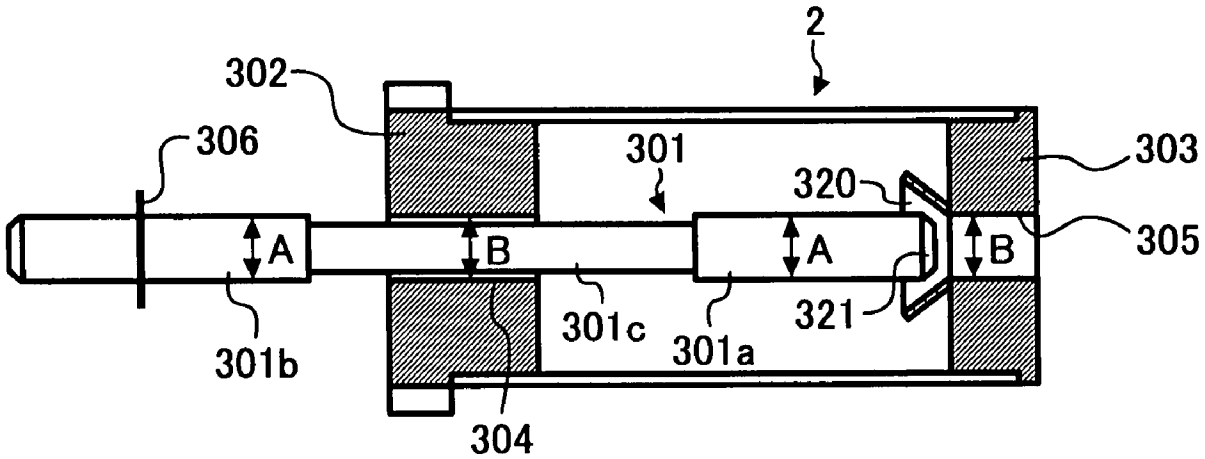
FIGS. 7A and 7B are longitudinal cross-sectional views of another structure of a through shaft and a photoconductive drum with flanges according to an exemplary embodiment of the present invention.
Figure 7B:
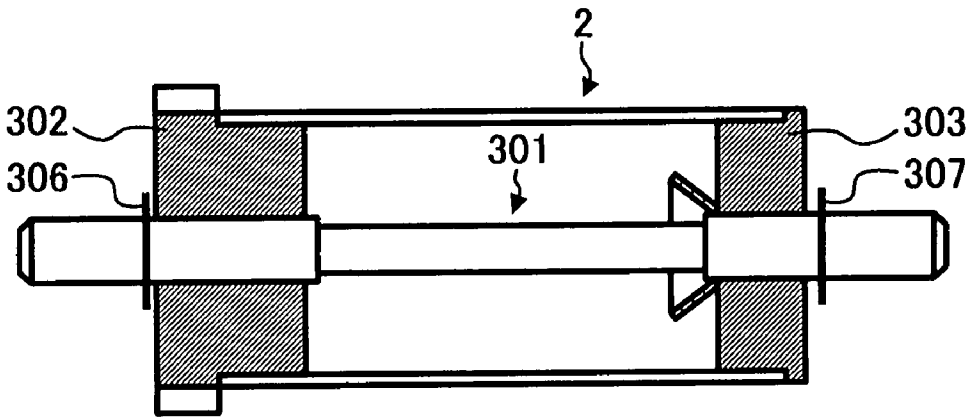

Referring to FIGS. 7A and 7B, the photoconductive drum 2 and a through shaft 301 are described according to another exemplary embodiment of the present invention.

In FIG. 7A, the through shaft 301 includes a leading end 301*a*, a trailing end 301*b*, and a center portion 301*c*. The leading and trailing ends 301*a* and 301*b* have an outer diameter A which is an outer diameter of a cross sectional portion of the through shaft 301. The outer diameter A of the leading and trailing ends 301*a* and 301*b* is made greater than an inner diameter B. The inner diameter B is an inner diameter of a cross sectional portion of an entrance opening 304 of the shaft entrance flange 302 and an exit opening 305 of the shaft exit flange 303. Also, an outer diameter of the center portion 301*c* of the through shaft 301 is formed slightly smaller than the outer diameter A of the leading and trailing ends 301*a* and 301*b* of the through shaft 301. When the through shaft 301 is installed, the leading end 301*a* and the trailing end 301*b* of the through shaft 301 are tightly held in contact with the exit and entrance openings 305 and 304, respectively. With this structure, the through shaft 301 may be fixedly engaged with the photoconductive drum 2, and thereby may improve a rotation accuracy of the photoconductive drum 2. The outer diameter A may be included in a portion where the leading and trailing ends 301*a* and 301*b* are held in contact with the entrance and exit openings 304 and 305 of the shaft entrance and exit flanges 302 and 303 when the through shaft 301 is engaged with to the photoconductive drum 2.

A locating snap ring 306 may be attached onto a predetermined portion of the trailing end 301*b* of the through shaft 301. The through shaft 301 is inserted into the shaft hole of the photoconductive drum 2 through the entrance opening 304 of the shaft entrance flange 302 towards the exit opening 305 of the shaft exit flange 303, as shown in FIG. 7A. At this time, the leading end 301*a* of the through shaft 301 does not easily go through the entrance opening 304 of the shaft entrance flange 302. This is because the outer diameter A of the leading end 301*a* is made slightly greater than the inner diameter B of the entrance opening 304, as previously described. If the through shaft 301 is further pushed, the leading end 301*a* may pass through the entrance opening 304 of the shaft entrance flange 302. After the leading end 301*a*, the center portion 301*c* of the through shaft 301 passes through the entrance opening 304. Since the center portion 301*c* includes the outer diameter smaller than the outer diameter A of the leading end 301*a*, a predetermined gap may be formed between an outer surface of the center portion 301*c* of the through shaft 301 and the inner surface of the shaft hole of the photoconductive drum 2. With this structure, the through shaft 301 can smoothly be inserted into the shaft hole of the photoconductive drum 2. The leading end 301*a* of the through shaft 301 is continuously pushed towards the exit opening 305 of the shaft exit flange 303. When the leading end 301*a* of the through shaft 301 passes through and protrudes the exit opening 305 of the shaft exit flange 303, the locating snap ring 306 attached onto the trailing end 301*b* of the through shaft 301 becomes close to the entrance opening 304 of the shaft entrance flange 302. After the leading end 301*a* of the through shaft protrudes the exit opening 305, the through shaft 301 is stopped at a predetermined position thereof, and a locating snap ring 307 is attached onto a predetermined portion of the through shaft 301 for fixing the through shaft 301 to the photoconductive drum 2 in its longitudinal direction, as shown in FIG. 7B.

Further, tests to examine a level of runouts of the photoconductive drum 2 were also conducted here under the same condition as previously described. That is, the tests were conducted by using the photoconductive drum 2 integrally engaged with the through shaft 301 and prevented from shifting in the axial direction. The photoconductive drum 2 which passed the tests is directly provided to the color printer 1 or it is once mounted to the cartridge unit, and then to the color printer 1.

According to this embodiment of the present invention, the outer diameter A of at least one end portion of the through shaft 301 is made smaller than the inner diameter B of the shaft entrance flanges 302. This makes a gap between the through shaft 301 and the inner surface of the entrance opening 304 of the shaft entrance flange 302, and reduces a resistance of insertion caused by the through shaft 301 when the through shaft 301 collides the inner surface of the entrance opening 304 of the shaft entrance flange 302. As a result, an operability of inserting the through shaft 101 may be improved.

In a case where the gap between the through shaft 301 and the entrance opening 304 of the shaft entrance flange 302 is wide, the leading end 301*a* of the through shaft 301 may smoothly be inserted. The leading end 301*a* of the through shaft 301, however, easily wobbles from side to side or up and down, which may cause an eccentricity of the through shaft 301, and may lose the exit opening 305 of the shaft exit flange 303. To avoid the above-described difficulty, the leading end 301*a* of the through shaft 301 may include a tapered tip 321, a diameter of which becomes smaller towards a leading edge thereof, as shown in FIG. 7A. In addition, a tapered guide 320 may be provided at the exit opening 305 of an inside surface of the shaft exit flange 303. The tapered guide 320 is a funnel-shaped member to guide the leading end 301*a* of the through shaft 301 to the exit opening 305 of the shaft exit flange 303. Since the tapered guide 320 of the shaft exit flange 303 and the tapered tip 321 of the leading end 301*a* of the through shaft 301 helps the leading end 301*a* of the through shaft 301 to find the exit opening 305 of the shaft exit flange 303, the through shaft 301 may be smoothly inserted thereto.

According to this embodiment of the present invention, the leading end 301*a* of the through shaft 302 includes the tapered tip 321, and the exit opening 305 of the shaft exit flange 303 includes the tapered guide 320 configured to guide the leading end 301*a* of the through shaft 301. With this structure, even when the through shaft 301 wobbles to find the exit opening 305 of the shaft exit flange 303, the taper guide 320 may guide the through shaft 301 to the exit opening 305 of the shaft exit flange 303. As a result, an operability of inserting the through shaft 301 may be increased.

Figure 8A:
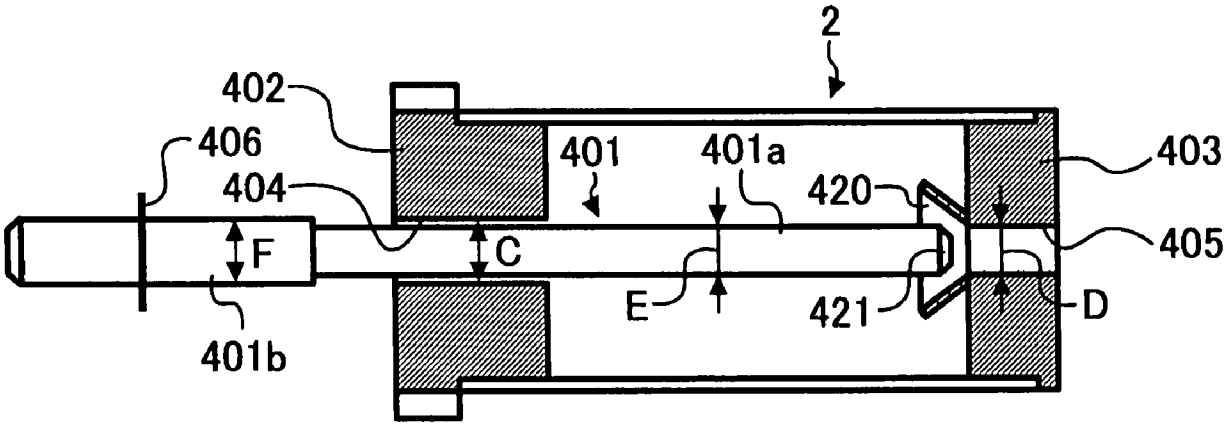
FIGS. 8A and 8B are longitudinal cross-sectional views of another structure of a through shaft and a photoconductive drum with flanges according to an exemplary embodiment of the present invention.
Figure 8B:
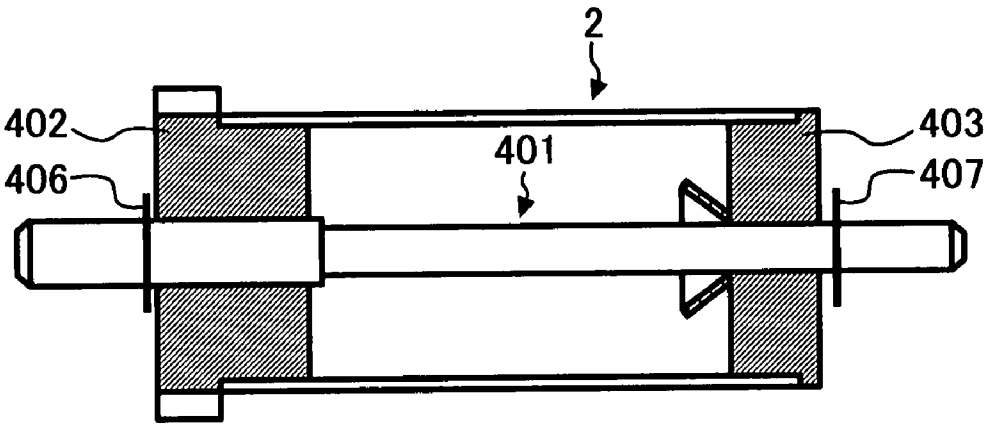

Referring to FIGS. 8A and 8B, another exemplary through shaft 401 alternative to the through shaft 301 in FIG. 7 of the color printer 1 according to the present invention is described. The photoconductive drum 2 and the through shaft 401 of FIG. 8A have similar structures to the photoconductive drum 2 and the through shaft 301 of FIG. 7A, except for inner diameters C and D, and outer diameters E and F.

In FIG. 8A, a shaft entrance flange 402 includes an entrance opening 404 with the inner diameter C, and a shaft exit flange 403 includes an exit opening 405 with the inner diameter D. The inner diameter C is made slightly larger than the inner diameter D. The through shaft 401 includes a leading end 401*a* and a trailing end 401*b*. The leading end 401*a* has the outer diameter E and is held in contact with an inner surface of the exit opening 405 when the through shaft 401 is engaged with the photoconductive drum 2. The trailing end 401*b* has the outer diameter F and is held in contact with an inner surface of the entrance opening 404 when the through shaft 401 is engaged with the photoconductive drum 2. The outer diameter E is made slightly smaller than the outer diameter F. The outer diameter E of the leading end 401*a* is slightly smaller than the inner diameter D of the exit opening 405. The outer diameter F of the trailing end 401*b* is slightly smaller than the inner diameter C of the entrance opening 404.

As shown in FIG. 8A, a locating snap ring 406 may be attached onto a predetermined portion of the training portion 401*b* of the through shaft 401, and then the through shaft 401 is inserted into the shaft hole of the photoconductive drum 2 through the entrance opening 404 of the shaft entrance flange 402. As previously described above, the outer diameter E of the leading end 401*a* is made smaller than the inner diameter C of the entrance opening 402, and thereby a predetermined gap may be formed between an inner surface of the entrance opening 404 of the shaft entrance flange 402 and an outer surface of the leading end 401*a* of the through shaft 401. With this structure, the through shaft 401 can smoothly be inserted into the photoconductive drum 2. When the through shaft 401 is further pushed until the locating snap ring 406 becomes close to an outer surface of the shaft entrance flange 402, the leading end 401*a* may slide to the outside of the shaft hole of the photoconductive drum 2. When the leading end 401*a* protrudes the exit opening 405 of the shaft exit flange 403, a locating snap ring 407 is attached onto a predetermined portion of the through shaft 401, as shown in FIG. 7B. Thus, the through shaft 401 is fixed to the photoconductive drum 2 and is prevented from shifting in an axial direction, as shown in FIG. 8B.

Same as the shaft exit flange 303 and the through shaft 301 of FIG. 7A, the shaft exit flange 403 may include a tapered guide 420 and the through shaft 401 may include the leading end 401*a* with a tapered tip 421 in FIG. 8A. A diameter of the tapered tip 421 becomes smaller towards a leading edge thereof. The tapered guide 420 may be provided at the exit opening 405 of an inside surface of the shaft exit flange 403. The tapered guide 420 is a funnel-shaped member to guide the leading end 401*a* of the through shaft 401 to the exit opening 405 of the shaft exit flange 403. Since the tapered guide 420 of the shaft exit flange 403 and the tapered tip 421 of the leading end 401*a* of the through shaft 401 helps the leading end 401*a* of the through shaft 401 to find the exit opening 405 of the shaft exit flange 403, the through shaft 401 may be smoothly inserted thereto.

According to this embodiment of the present invention, the inner diameter of the exit opening 405 of the shaft exit flange 403 is made smaller than the inner diameter of the entrance opening 404 of the shaft entrance flange 402. Accordingly, the outer diameter of the through shaft 401 having the leading end 401*a*, which is held in contact with the entrance opening 404 of the shaft entrance flange 402, may be made smaller than the inner diameter of the entrance opening 404 of the shaft entrance flange 402. With this structure, an operability of inserting the through shaft 401 may be improved.

Figure 9:
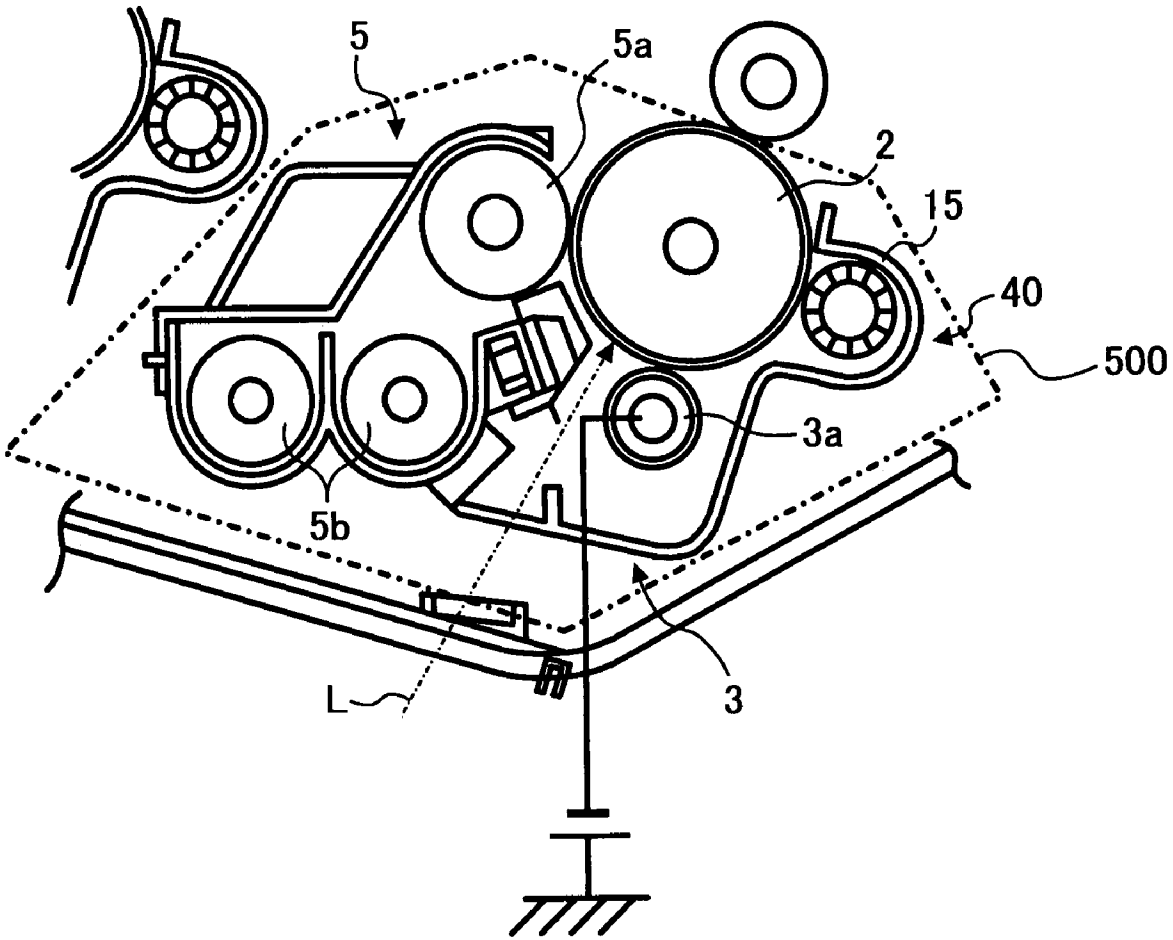
FIG. 9 is a cross-sectional view of a structure of a process cartridge included in the color printer of FIG. 1.

Referring to FIG. 9, a structure of a process cartridge 500 according to an exemplary embodiment of the present invention is described. Even though the following descriptions show functions and actions of the process cartridge 500 in a general manner, it should be noted that the color printer 1 includes process cartridges 500Y, 500C, 500M and 500BK which have similar structures to the process cartridge 500, except toners of different colors.

As shown in FIG. 9, the process cartridge 500 includes image forming components such as the photoconductive drum 2, the developing unit 5, the charging unit 3 and the cleaning unit 15 of FIG. 2. The functions of the respective units have previously been described above.

Figure 10:
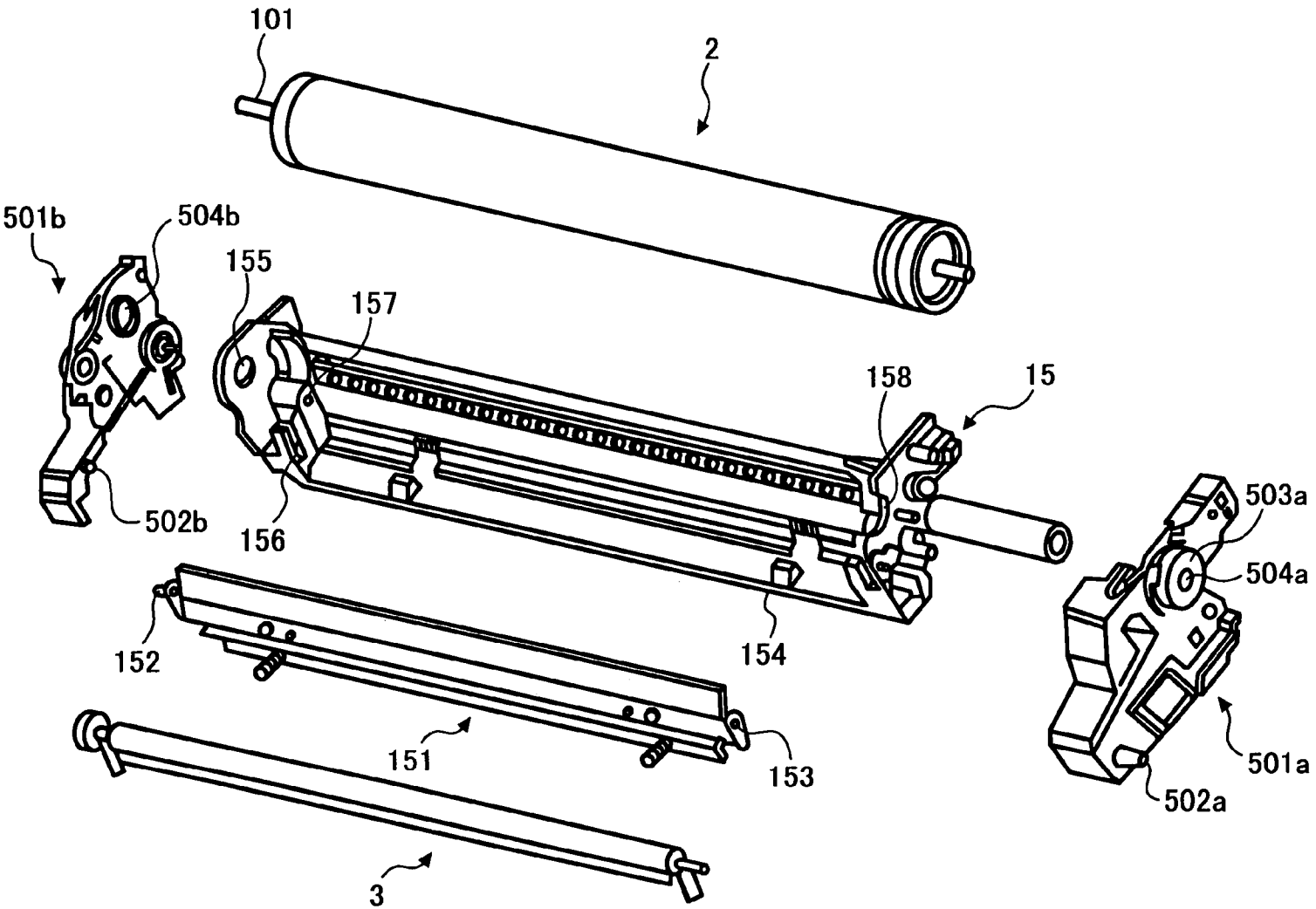
FIG. 10 is an exploded view of the process cartridge of FIG. 9.

Referring to FIG. 10, a method of assembling the process cartridge 500 of FIG. 9 is described.

When the process cartridge 500 is assembled, the photoconductive drum 2, the charging unit 3, and a cleaning blade 151 are mounted to a cleaner case 154 of the cleaning unit 15 as shown in FIG. 10.

The cleaning blade 151 includes a cleaning blade projection 152 and a cleaning blade hole 153. The cleaning blade projection 152 is arranged at the left-end portion of the cleaning blade 151 in FIG. 10 and the cleaning blade hole 153 is arranged at the right-end portion of the cleaning blade 151 in FIG. 10.

The cleaner case 154 includes a drum mounting hole 155, a charging unit mounting detent 156, and a blade mounting hole 157 on a left-side wall thereof in FIG. 10, and also includes a drum supporting member 158, a charging unit mounting detent (not shown), and a blade mounting projection (not shown) on a right-side wall thereof in FIG. 10.

Firstly, the cleaning blade 151 is fixed to the cleaner case 154 of the cleaning unit 15. The cleaning blade projection 152 is inserted into the blade mounting hole 157. By engaging the cleaning blade projection 152 with the blade mounting hole 157, the cleaning blade 151 is fixedly mounted to the cleaner case 154 of the cleaning unit 15.

Next, the charging unit 3 is attached to the cleaner case 154. The charging unit 3 includes engaging members on both ends thereof. As previously described, the cleaner case 154 includes two detents in an axial direction of the cleaner case 154 for mounting the charging unit 3. The one end of the charging unit 3 is engaged with the charging unit mounting detent 156 and the other end of the charging unit 3 is engaged with the charging unit mounting detent (not shown). In this manner as described above, the charging unit 3 is successfully mounted to the process cartridge 500.

The photoconductive drum 2 is then mounted to the cleaner case 154. As shown in FIG. 10, the through shaft 101 is integrally mounted to the photoconductive drum 2. To mount the photoconductive drum 2 to the cleaner case 154, one end of the through shaft 101 is inserted into a drum mounting hole 155 arranged at the left-side wall of the cleaner case 154. The other end of the through shaft 101 is placed into the drum supporting member 158 arranged at the right-side wall of the cleaner case 154. In this manner as described above, the photoconductive drum 2 is mounted to the cleaner case 154.

Then, a side plate 501*a* and a side plate 501*b* of the process cartridge 500 are mounted to the cleaner case 154. The side plate 501*a* to be mounted to the right-side wall of the cleaner case 154 includes a developing unit mounting member 502*a*, a through shaft bearing member 503*a* having a shaft mounting hole 504*a*. The shaft mounting hole 504*a* has an inner diameter which is a substantially same size as that of an outer diameter of the through shaft 101. To mount the side plate 501*a* to the cleaner case 154, the through shaft 101 is inserted into the shaft mounting hole 504*a* of the through shaft bearing member 503*a*.

After the side plate 501*a* is mounted to the cleaner case 154, the side plate 501*b* of the process cartridge 500 is also arranged to the opposite side of the cleaner case 154. The side plate 501*b* includes a developing unit mounting member 502*b*, a through shaft bearing member (not shown) having a shaft mounting hole 504*b*. These components of the side plate 501*b* have same functions as those of the side plate 501*a*. To mount the side plate 501*b*, the through shaft 101 is inserted into the shaft mounting hole 504*b* of the through shaft bearing member. By engaging the shaft mounting holes 504*a* and 504*b* with respective end portions of the through shaft 101, the photoconductive drum 2 is positioned to the process cartridge 500. Then, the side plate 502*b* is fixedly mounted to the cleaner case 154.

In addition to the above-described components, the developing unit 5 may be mounted to the process cartridge 500. The developing unit 5 includes engaging members corresponding to the developing unit mounting members 502*a* and 502*b* of the respective side plate 501*a* and 501*b*. By engaging the developing unit mounting members 502*a* and

502*b* with the respective engaging members of the developing unit 5, the developing unit 5 may be mounted to the process cartridge 500.

Figure 11:
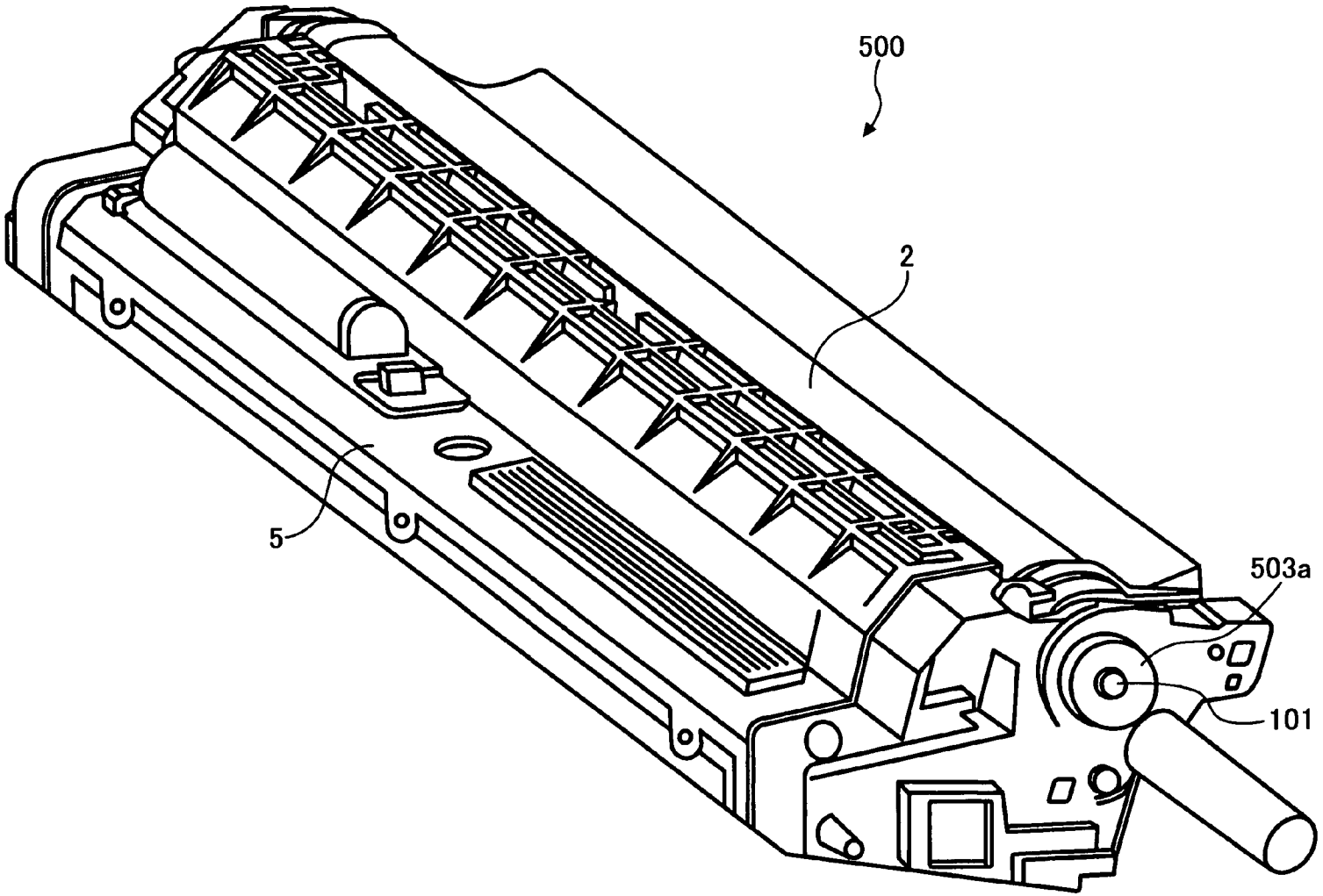
FIG. 11 is a perspective view of the process cartridge of FIG. 9.

After the image forming components are mounted to the process cartridge 500 as described above, the process cartridge 500 is completely assembled as shown in FIG. 11.

According to the present invention, the photoconductive drum 2 integrally engaged with the through shaft 101 is provided to the process cartridge 500. That is, the through shaft 101 may not be inserted after the photoconductive drum 2 is installed to the process cartridge 500. As a result, an ability of assembling and disassembling the process cartridge 500 may be improved. Therefore, the process cartridge 500 may have high replacement capability and recycling efficiency.

Numerous additional modifications and variations are possible in light of the above teachings. It is therefore to be understood that within the scope of the appended claims, the disclosure of this patent specification may be practiced otherwise than as specifically described herein.

What is claimed as new and desired to be secured by letters patent of the United States is:

1. An image bearing mechanism comprising:

an image bearing member having a hollow cylindrical shape and first and second open end portions;

a first flange including a first opening at a center portion thereof and fixed at the first open end portion of the image bearing member;

a second flange including a second opening at a center portion thereof and fixed at the second open end portion of the image bearing member; and a through shaft extending through the first opening of the first flange and the second opening of the second flange to rotatably support the image bearing member, wherein the through shaft is configured to be fixedly engaged with the image bearing member, wherein the through shaft includes first and second end portions that are accommodated in the first opening of the first flange and the second opening of the second flange, respectively, and wherein outer radial diameters of the first and second end portions of the through shaft are greater than other portions of the through shaft between the first and second end portions.

2. The image bearing mechanism according to claim 1, wherein a leading end of the through shaft has a tapered surface.

3. The image bearing mechanism according to claim 1, wherein the through shaft is fixedly engaged to the image bearing member by the through shaft being fixedly engaged to the first flange.

4. The image bearing mechanism according to claim 3, wherein the through shaft is further fixedly engaged to the image bearing member by the through shaft being fixedly engaged to the second flange.

5. The image bearing mechanism according to claim 4, wherein the first and second end portions each have an outer radial diameter that is smaller than an inner radial diameter of the first opening of the first flange and the second opening of the second flange.

6. The image bearing mechanism according to claim 5, wherein the through shaft includes a leading end having a tapered surface, and wherein the second opening of the second flange comprises a tapered guide configured to guide the leading end of the through shaft into the second opening during insertion of the through shaft.

7. The image bearing mechanism according to claim 5, wherein the through shaft comprises retaining members configured to retain the through shaft within the image bearing member, and wherein the retaining members are provided at respective positions outside and close to outer surfaces of the first flange and the second flange.

8. An image forming apparatus comprising:

an image forming mechanism configured to form an image; and an image bearing mechanism configured to bear an image formed by the image forming mechanism, said image bearing mechanism comprising:

an image bearing member having a hollow cylindrical shape and first and second open end portions:

a first flange including a first opening at a center portion thereof and fixed at the first open end portion of the image bearing member;

a second flange including a second opening at a center portion thereof and fixed at the second open end portion of the image bearing member; and a through shaft extending through the first opening of the first flange and the second opening of the second flange to rotatably support the image bearing member, wherein the through shaft is configured to be fixedly engaged with the image bearing member, wherein the through shaft includes first and second end portions that are accommodated in the first opening of the first flange and the second opening of the second flange, respectively, and wherein outer radial diameters of the first and second end portions of the through shaft are greater than other portions of the through shaft between the first and second end portions.

9. The image forming apparatus according to claim 8, wherein a leading end of the through shaft has a tapered surface.

10. The image forming apparatus according to claim 8, wherein the through shaft is fixedly engaged to the image bearing member by the through shaft being fixedly engaged to the first flange.

11. The image forming apparatus according to claim 10, wherein the through shaft is further fixedly engaged to the image bearing member by the through shaft being fixedly engaged to the second flange.

12. The image forming apparatus according to claim 11, wherein the first and second end portions each have an outer radial diameter that is smaller than an inner radial diameter of the first opening of the first flange and the second opening of the second flange.

13. The image forming apparatus according to claim 12, wherein the through shaft includes a leading end having a tapered surface, and wherein the second opening of the second flange comprises a tapered guide configured to guide the leading end of the through shaft into the second opening during insertion of the through shaft.

14. The image forming apparatus according to claim 12, wherein the through shaft comprises retaining members configured to retain the through shaft within the image bearing member, and wherein the retaining members are provided at respective positions outside and close to outer surfaces of the first flange and the second flange.

* * * * *